United States Patent [19]

Ogasawara

[11] 4,341,319

[45] Jul. 27, 1982

[54] VIRGIN SEALED INNER CLOSURE CAP

[75] Inventor: Hirotake Ogasawara, Funabashi, Japan

[73] Assignee: Yoshida Industry Co., Ltd., Tokyo, Japan

[21] Appl. No.: 240,612

[22] Filed: Mar. 5, 1981

[51] Int. Cl.[3] ..... B65D 41/34

[52] U.S. Cl. ..... 215/307

[58] Field of Search ..... 215/307, 232; 220/254

[56] References Cited

FOREIGN PATENT DOCUMENTS 1365721 9/1974 United Kingdom ..... 215/307

*Primary Examiner*—Donald F. Norton

*Attorney, Agent, or Firm*—Wenderoth, Lind & Ponack

[57] ABSTRACT

A virgin sealed inner closure cap for container is provided which comprises a base cap member made of one thermoplastic resin and provided with a pour-out hole through the upper end wall thereof and a plug member removably fitted to said pour-out hole and having a holding tongue thereon. The plug member is made of another thermoplastic resin, which has no chemical affinity with that of the base cap member, and lightly attached to the base cap member to cover the pour-out hole by pressing the plug member against the base cap member while the plug member is molten by heating.

4 Claims, 5 Drawing Figures

VIRGIN SEALED INNER CLOSURE CAP

BACKGROUND OF THE INVENTION

This invention relates to a virgin sealed inner closure cap for a small container such as cosmetic tube, bottle or the like.

In a small bottle especially for containing cosmetic liquid material therein, an inner closure cap having a small hole therethrough is tightly fitted to an open mouth in the neck of the bottle to limit the discharge amount of the cosmetic liquid material into a small one. Such inner closure cap is fitted after the liquid material is filled into the bottle through the open mouth thereof. Then, the inner closure cap is covered by an outer closure cap which is fitted to or engaged with an external thread at the neck of the bottle.

Recently, in order to visually prove that the cosmetic liquid material in the bottle has not been used at all after filling thereof until delivered to a user, it has been proposed to provide a virgin seal structure in the inner closure cap of the bottle. One of the proposed virgin seal structures is to form a tear-off cover portion which is integrally molded with the inner closure cap. The tear-off cover portion is normally defined from the reminder of the inner closure cap by a circular thin wall portion or by a circular perforation line and is designed to be torn off along the thin wall portion or the perforation line by pulling a projecting tongue integrally formed on the tear-off cover portion. However, it has been very difficult to form the circular thin wall portion or the circular perforation line in such a manner that the tear-off cover portion can be removed very easily. Especially, such is the case when the inner closure cap is a small one such as a cosmetic bottle or tube.

Another proposal of the virgin seal structure is to form a hollow closed protrusion integral with the inner closure cap, which protrusion is adapted to be cut out by a knife or scissors. However, such a structure is not desirable because the protrusion cannot be cut out so easily without using the knife or scissors. Also, the shape of the inner closure cap is somewhat limited due to the hollow closed protrusion thereon.

Accordingly, an object of the present invention is to provide a virgin sealed inner closure cap for a small container which can form a pour-out hole very easily without using a special tool.

Another object of the present invention is to provide a virgin sealed inner closure cap especially suited for fitting to a small open mouth in the neck of a bottle such as a cosmetic bottle.

SUMMARY OF THE INVENTION

According to the present invention, a virgin sealed inner closure cap is provided, which is tightly fitted to an open mouth in the neck of a container and covered by an outer closure cap engageable with the outer periphery of the neck. The inner closure cap comprises a base cap member made of one thermoplastic resin for fitting to the open mouth in the neck of the container and provided with a pour-out hole through the upper end wall thereof. The inner closure cap further comprises a removable plug member made of thermoplastic resin, which has no chemical affinity with that of the base cap member, and attached to the base cap member to cover the pour-out hole by pressing the plug member against the base cap member while the plug member is molten by heating. The plug member has an integral tongue thereon adapted to be held by fingers and pulled up for removal of the plug member from the base cap member.

Other objects and features of the present invention will become apparent from the following detailed description of preferred embodiments thereof, when taken in conjunction with the accompanying drawings, in which:

DETAILED DESCRIPTION OF THE INVENTION

Figure 1:
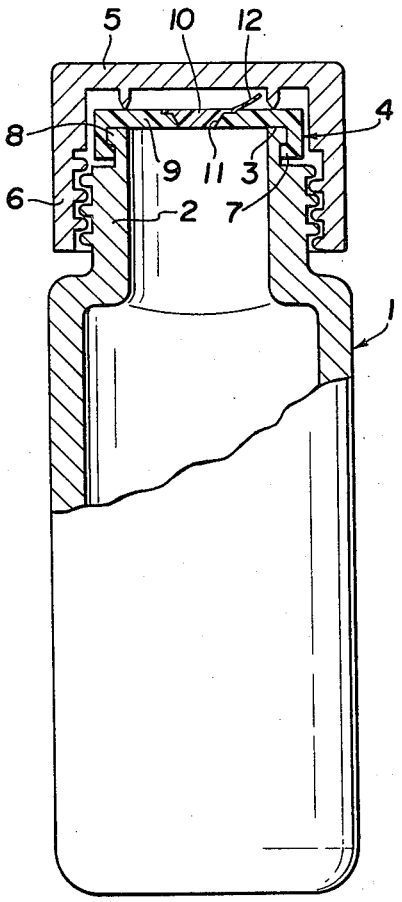
FIG. 1 is a vertical sectional view showing a cosmetic bottle covered with virgin sealed inner closure cap according to a first embodiment of the present invention.
Figure 2:
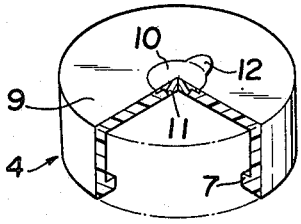
FIG. 2 is a partially sectioned perspective view showing the inner closure cap in FIG. 1.
Figure 3:
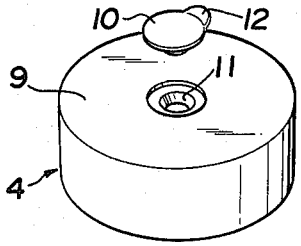
FIG. 3 is a perspective view showing the inner closure cap in the first embodiment with a plug member being removed from a base cap member.

Referring now to a first embodiment of the present invention shown in FIGS. 1 through 3, reference numeral 1 designates a cosmetic bottle for containing a cosmetic liquid material therein. The bottle 1 has an externally threaded neck portion 2, the upper end of which provides an open mouth 3 for the bottle. After filling the bottle 1 with the cosmetic liquid material, the open mouth 3 is covered with an inner closure cap 4 of the present invention. The inner closure cap 4 is enclosed and covered with an outer closure cap 5 which has an internally threaded skirt portion 6 engaged with the externally threaded neck portion 2 of the bottle 1. The inner closure cap 4 is provided to limit the discharge amount of the cosmetic liquid material into small one when it is desired to pour out the liquid material. The inner closure cap 4 is tightly engaged with the open mouth portion of the bottle 1 so as not to be removed therefrom so easily. For example, the inner closure cap 4 made of resilient plastic material has a radially inwardly projecting annular flange 7 at the lower open end thereof which is engaged by press-fit with a radially outwardly projecting annular flange 8 at the upper end of the bottle 1.

The inner closure cap 4 of the present invention comprises a base cap member 9 and a removable plug member 10. The base cap member 9 has the annular flange 7 engageable with the upper end of the bottle 1 and also has a pour-out hole 11 at the center portion thereof. The pour-out hole 11 generally has an inverted frusto-conical shape and is closed by the plug member 10 having a tongue 12 thereon. The base cap member 10 is formed from thermoplastic resin by injection molding. The plug member 10 is also formed another type of thermoplastic resin by injection molding. The thermoplastic resin of the base cap member 9 is selected from such material that has no chemical affinity with the other thermoplastic resin of the plug member 10. This means that when one molten thermoplastic resin is brought into contact with the other molten thermoplastic resin, the both thermoplastic resins cannot be integrally combined with each other but separated from each other after solidification thereof without applying a substantial force for pulling apart. Preferably, polyethylene resin is used as the one resin for forming the base cap member 9 or the plug member 10, and polypropylene resin or polystyrene resin is used for forming the other member. In the practical embodiment, the base cap member 9 is initially formed from polyethylene resin and then the polypropylene resin is injected into the pour-out hole 11 of the base cap member 9 by injection molding method. Although the polyethylene and polypropylene resins have no chemical affinity with each other as set forth above, since the polypropylene resin for the plug member is injected under substantial pressure, the formed plug member 10 is lightly adhered to the base cap member 9 to completely close and seal the pour-out hole 11. The adhesion of the formed plug member 10 is, however, firm enough to prevent any leakage of the liquid material in the bottle even when the bottle is shook by holding it upside down. When it is desired to use the cosmetic liquid in the bottle for the first time, the user can remove the plug member 10 quite easily by holding the tongue 12 on the plug member 10 and pulling it up. Since the plug member 10 is not integrally welded with the base cap member 9, the inverted frusto-conical wall of the base cap member 9 defining the pour-out hole 11 is very clean and substantially no trace of welding remains thereon.

Once the plug member 10 is removed from the base cap member, the pour-out hole 11 of the base cap member cannot be sealed any more by the plug member 10. Accordingly, anyone can know visually that the cosmetic bottle covered with the present inner closure cap 4 having the plug member 10 attached thereon is virgin and provides a visual proof of any unauthorized opening of the bottle.

Figure 4:
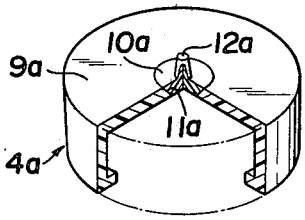
FIG. 4 is a partially sectioned perspective view showing a virgin sealed inner closure cap according to a second embodiment of the present invention.

In a second embodiment of the present invention shown in FIG. 4, another type of virgin sealed inner closure cap **4*a* is provided which comprises a plug member 10*a* different from that of the first embodiment. That is, a tongue 12*a* on the plug member 10*a* projects upwardly from the center thereof. Such a plug member 10*a* is very easy to mold on a pour-out hole 11*a* in a base cap member 9*a* by injection molding. Other structures and features of the inner closure cap 4*a*** of the second embodiment are substantially the same as those described in the first embodiment.

Figure 5:
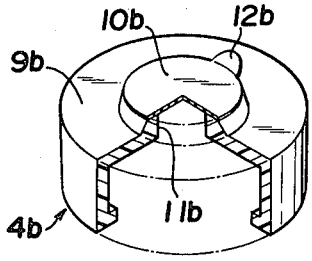
FIG. 5 is a partially sectioned perspective view showing a virgin sealed inner closure cap according to a third embodiment of the present invention.

Referring to a third embodiment of the present invention shown in FIG. 5, still another type of virgin sealed inner closure cap **4*b* is provided in which a plug member 10*b* is a sheet made of thermoplastic resin. The sheet-shaped circular plug member 10*b* having a tongue 12*b* thereon is pressed against the periphery of a pour-out hole 11*b* in a base cap member 9*b* under heating until the sheet-shaped plug member 10*b* is partially molten. The molten part of the sheet-shaped plug member is lightly adhered under pressure upon the periphery of the pour-out hole 11*b* to close the latter. In this embodiment, the pour-out hole 11*b* is formed in a projection at the center of the base cap member 9*b*, so that the pressing of the sheet-shaped plug member 10*b* against the periphery of the pour-out hole can be performed very easily. As in the case of the previous embodiment, the base cap member 9*b* is made of polyethylene resin and the sheet-shaped plug member 10*b*** is made of polypropylene resin or polystyrene resin.

As it could be understood from the descriptions of the preferred embodiments of the present invention, the plug member 10 is formed from one theremoplastic resin having no chemical affinity with the other thermoplastic resin of the base cap member 9 and the former is lightly adhered to the latter by application of pressure under heating. Accordingly, although the sealing of the plug member is sufficient to prevent any leakage of liquid material in a container, the plug member can be removed quite easily as desired from the base cap member by a very small pulling force. The attaching or adhering of the plug member to the pour-out hole of the base cap member can be carried out very easily when the molten thermoplastic resin for the plug member is injected to the pour-out hole of the base cap member which has previously been formed before injection of the resin for plug member.

Although the present invention has been described with reference to the preferred embodiments thereof, many modifications and alterations may be made within the spirit of the present invention.

What is claimed is:

1. A virgin sealed inner closure cap for a small container adapted to be tightly fitted to an open mouth in the neck of said container and covered by an outer closure cap engageable with the outer periphery of said neck, said inner closure cap comprising a base cap member made of one thermoplastic resin for fitting to said open mouth in the neck of said container and provided with a pour-out hole through the upper end wall thereof and a plug member removably fitted to said pour-out hole and having a holding tongue thereon, wherein said plug member is made of another thermoplastic resin, which has no chemical affinity with that of said base cap member, and lightly attached to said base cap member to cover said pour-out hole by pressing said plug member against said base cap member while said plug member is molten by heating.

2. A virgin sealed inner closure cap for a container as claimed in claim 1, wherein said base cap member is made of polyethylene resin and said plug member is made of polypropylene resin or polystyrene resin.

3. A virgin sealed inner closure cap for a container as claimed in claim 1 or 2, wherein said plug member is formed on said pour-out hole of the preformed base cap member by injection molding.

4. A virgin sealed inner closure cap for a container as claimed in claim 1 or 2, wherein said plug member is made of sheet of said thermoplastic resin and pressed against the periphery of said pour-out hole under heating to partially melt said sheet.

* * * * *